US005339383A

United States Patent [19]

Marino

[11] Patent Number: 5,339,383

[45] Date of Patent: Aug. 16, 1994

[54] ELECTRICAL HUMIDIFER WITH DETACHABLE CONNECTOR PLUG SAFETY INTERLOCK SYSTEM ALLOWING INTERIOR ACCESS ONLY WHEN UNPLUGGED

[75] Inventor: Frank Marino, Upton, Mass.

[73] Assignee: Duracraft Corporation, Whitinsville, Mass.

[21] Appl. No.: 988,590

[22] Filed: Dec. 8, 1992

Related U.S. Application Data

[62] Division of Ser. No. 921,531, Jul. 29, 1992, Pat. No. 5,228,107.

[51] Int. Cl.[5] ..... H05B 1/02; F24F 3/14

[52] U.S. Cl. ..... 392/406; 261/142; 261/DIG. 65; 392/335; 392/445

[58] Field of Search ..... 392/403–406, 392/402, 335, 444–448; 261/142, DIG. 65

[56] References Cited

U.S. PATENT DOCUMENTS

| | | | |
|---|---|---|---|
| 1,625,034 | 4/1927 | Lawner | 392/335 |
| 1,743,823 | 1/1930 | Lawner | 392/335 |
| 1,797,457 | 3/1931 | Weiss | 392/335 |
| 1,809,729 | 5/1931 | Aitken | 392/335 |
| 4,338,510 | 7/1982 | Chihara et al. | 392/335 X |
| 4,810,854 | 3/1989 | Jursich et al. | 392/405 |
| 5,014,338 | 5/1991 | Glucksman | 392/406 X |

OTHER PUBLICATIONS

Bemis Waterwick Owners Care & Use Manual printed in U.S.A.; Bemis Manufacturing Co.

Model 4273 Two-Speed Air Care® Humidifier/Air Cleaner photograph (see Section 9 for concise explanation).

*Primary Examiner*—Anthony Bartis

*Attorney, Agent, or Firm*—John E. Toupal; Harold G. Jarcho

[57] ABSTRACT

An electric humidifier includes a base defining a liquid reservoir and a latch aperture. A humidifier unit is hingedly mounted on the base over the reservoir and movable to provide access thereto. The humidifier unit includes an electrically energized humidification means for inducing dispersion of liquid through a discharge opening into a space to be humidified. Power is supplied to the humidification unit and aligned with the latch aperture on the base when the humidifier unit is operatively mounted on the base. A power supply cord has a plug detachably connected to the connector through the latch aperture. The engagement of the connected plug with the latch aperture prevents movement of the humidifier with respect to the base to prevent access to the reservoir and interior of the humidifier unit so long as the plug and connector are in operative engagement.

4 Claims, 7 Drawing Sheets

ELECTRICAL HUMIDIFER WITH DETACHABLE CONNECTOR PLUG SAFETY INTERLOCK SYSTEM ALLOWING INTERIOR ACCESS ONLY WHEN UNPLUGGED

This is a division of U.S. Ser. No. 07/921,531, filed Jul. 29, 1992, now U.S. Pat. No. 5,228,107.

BACKGROUND OF THE INVENTION

This invention relates generally to a portable electric humidified and more particularly, to a portable electric humidifier with an automatically de-energized removable humidification unit.

Portable humidifiers are used commonly to enhance environmental conditions in residential and commercial building. One well known type of humidifier employs a liquid supply tank and a humidification unit both removably mounted on a base that defines a reservoir. The humidification unit includes an electrically energized heater coil that projects into the reservoir so as to induce dispersion of liquid retained therein. Cleaning of the base and reservoir is facilitated by removal of the tank and humidification unit from the base. Also known (U.S. Pat. No. 5,015,338) is a portable humidifier having a humidification unit hinged to a base and pivotable into a position that provides access to a reservoir.

Various safety hazards are created by displacement of a liquid supply tank or an electrically energized humidification unit from a proper operating position on a base, particularly a unit having an exposed heater coil. Those problems are addressed in U.S. Pat. No. 5,133,044 which discloses a system for automatically de-energizing a heater coil in response to relative movement between a base and a humidification unit retained thereby, and U.S. Pat. No. 5,131,070 which discloses a humidification unit that is automatically de-energized in response to removal of a supply tank from a base. Included in the first disclosed system is an electrical switch mounted in the humidification unit and operated by an actuator mounted in the base. Also known is a portable humidifier which attempts to prevent unsafe operation by utilizing a power cord and passes through a window in a base and connects to a removable humidification unit. However, by drawing the still connected power cord through the window in the base as the unit is removed, unsafe continued energization of the unit can occur.

The object of this invention, therefore, is to provide an improved portable humidifier in which unsafe operation is prevented.

SUMMARY OF THE INVENTION

In one form, the invention is a humidifier including a base defining a reservoir and a latch aperture; a humidifier unit mounted in an upright orientation on the base over the reservoir and movable to provide access thereto, the humidifier unit retaining an electrically energized humidification means for inducing dispersion of liquid and defining a discharge opening for discharging liquid dispersed by the humidification means; and a circuit coupled to the humidification means and selectively an on-off switch for controlling energization thereof, a detachable electrical connector retained by and connected to the humidification means and aligned with the latch aperture when the humidifier unit is operatively mounted on the base, and a power cord having an electrical plug connectable with the connector through the aperture when the humidifier unit is operatively mounted on the base. Engagement between the plug and the latch aperture of the base prevents movement of the humidifier unit relative to the base to prevent access to the reservoir so long as the plug and the connector are in operative engagement.

According to one feature of the invention, the humidifier also includes a tank removably mounted on the base and adapted to feed liquid into said reservoir. The tank maintains a supply of liquid in the reservoir.

According to another feature of the invention, the humidifier includes a hinge attaching the humidifier unit to the base. The hinge permits pivotal movement of the unit to provide access to the reservoir.

According to yet another feature of the invention, the humidifier u nit includes an electrically energized heater disposed in the reservoir. The heater provide efficient liquid dispersion while the orientation responsive switch prevents unsafe energization thereof.

In another form of the invention, the humidifier unit includes an on-off switch having a latch arm and the base defines a latch receptacle. In an on position of the switch, the latch arm engages the receptacle to prevent displacement of the energized humidifier.

In still another form of the invention, a hinged humidifier unit retains an electrical connector connected to a humidification means and a base defines a latch aperture. A power cord passes through the aperture and includes a plug connected to the connector and engaged by the base to prevent pivotal movement of the humidifier unit.

In still another form of the invention, a humidifier includes a deactivation mechanism for inducing de-energization of a humidification means in response to displacement of a humidifier unit from a base, and a coupling for preventing removal of a supply tank from a base with a movable humidifier unit mounted thereon. The coupling prevents unsafe energization of the humidifier unit with the supply tank removed.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
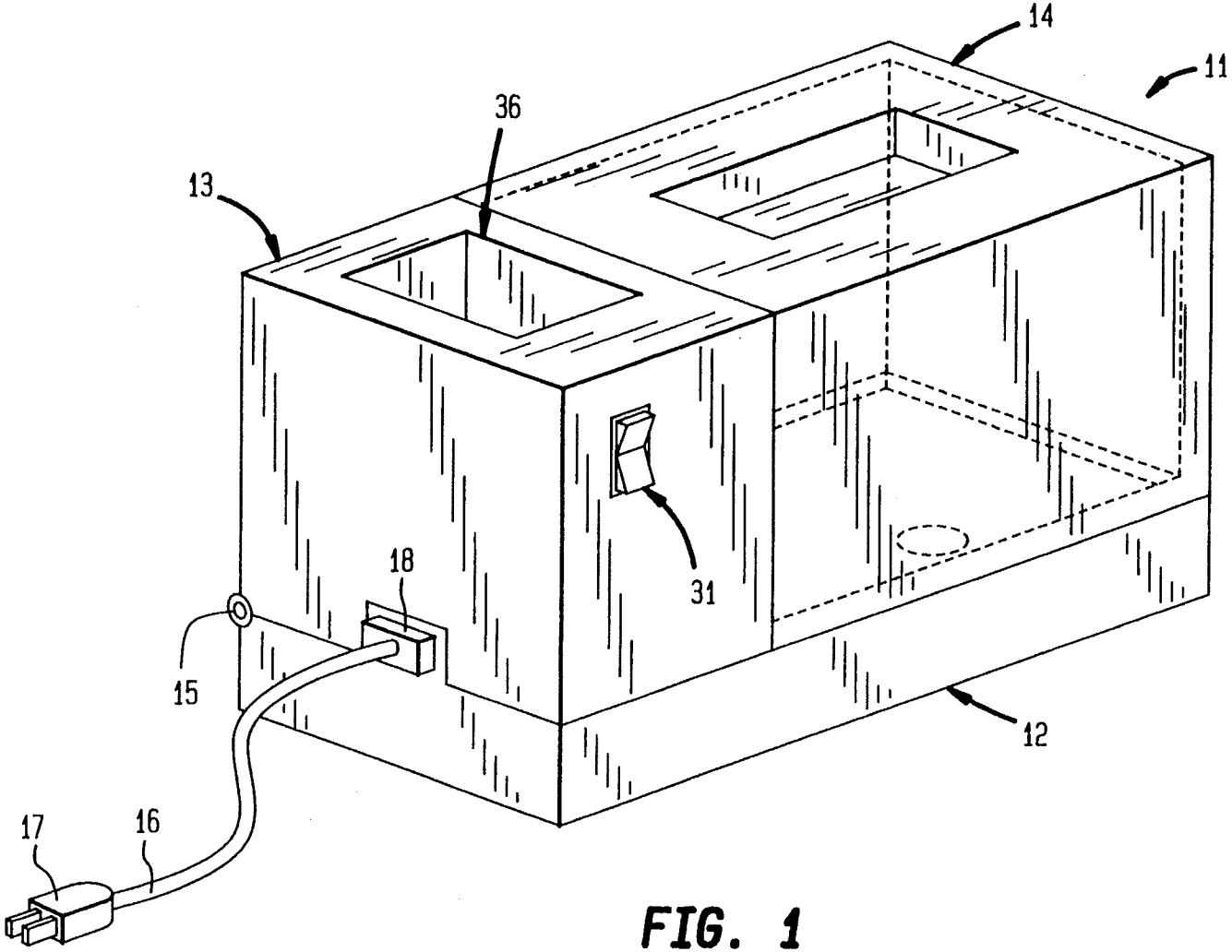
FIG. 1 is a front perspective view of a portable humidifier according to the invention.

A portable electric humidifier 11 includes a base 12, a humidifier unit 13 and a liquid supply tank 14. The tank 14 is removably mounted on the base 12. Pivotally attaching the humidifier unit 13 to the base 12 is a hinge 15. A power cord 16 has a male plug 17 for connection to an a.c. outlet and a female plug 18 connected to the humidifier unit 13.

Figure 2:
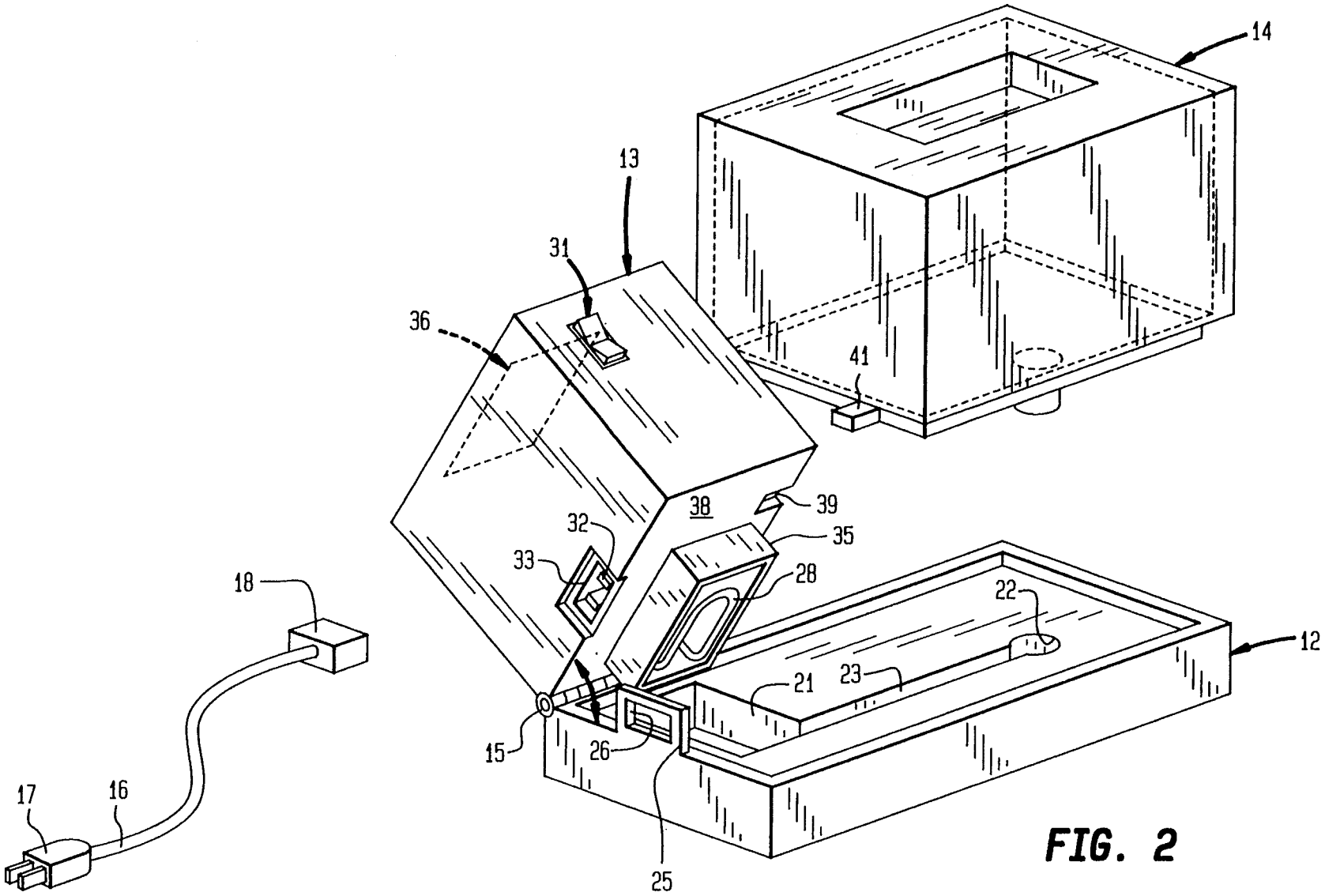
FIG. 2 is a perspective view of the humidifier shown in FIG. 1 with a tank and humidification unit displaced.

As shown in FIG. 2, the base 12 defines a reservoir cavity 21 and an input cavity 22 joined by a channel 23. Liquid is discharged in a conventional manner by the tank 14 into the input cavity 22 and then flows through the channel 23 to maintain a predetermined liquid level in the reservoir 21. Also formed on the base 12 is an upwardly projecting tab 25 that defines a deactivation insuring aperture 26 shaped to conform to the plug 18 on the power cord 16.

Figure 3:
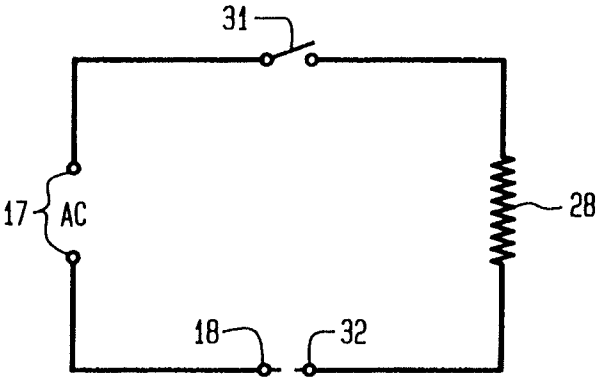
FIG. 3 is a circuit diagram for the humidifier of FIGS. 1 and 2.

The humidification unit 13 retains a humidification inducing heater coil 28 which projects into the reservoir 21 with the unit 13 mounted upright on the base 12 as shown in FIG. 1. Also retained by the unit 13 is a manually operated on-off switch 31 and a male connector 32 disposed in a socket 33 and interconnected with the switch 31, and the heater coil 28 as shown in FIG. 3. The unit 13 has a moisture inlet opening 35 that opens into the reservoir 21 and a discharge disposed in a socket 33 and interconnected with the switch 31, and the heater coil 28 as shown in FIG. 3. The unit 13 has a moisture inlet opening 35 that opens into the reservoir 21 and a discharge opening 36 for discharging moisture dispersed by a heater coil 28 and communicating with the inlet opening 35. Defined in a bottom wall 38 of the unit 13 is a laterally projecting coupling slot 39 that receives a laterally projecting coupling tab 41 on the tank 14 with both the unit 13 and tank 14 mounted on the base 12 as shown in FIG. 1.

With the plug 17 is an active outlet (not shown) and the plug 18 connected to the connector 32 as shown in FIG. 1, the switch 31 can be operated to induce electrical energization of the heater coil 28. With the unit 13 mounted on the base 12 engagement between the coupling elements 39, 41 prevents removal of the tank 14 from the base 12. To remove the tank 14 for refilling, the unit 13 must first by pivoted into its displaced position shown in FIG. 2 to decouple the elements 39, 41. However, such pivotal movement is only possible after removal of the plug 18 from the aperture 26 to eliminate engagement with the tab 25 on the base 12. Thus, the coupling elements 39, 41 and deactivation mechanism 18, 32 insure de-energization of the heater coil 28 before removal of the tank 14.

Figure 4:
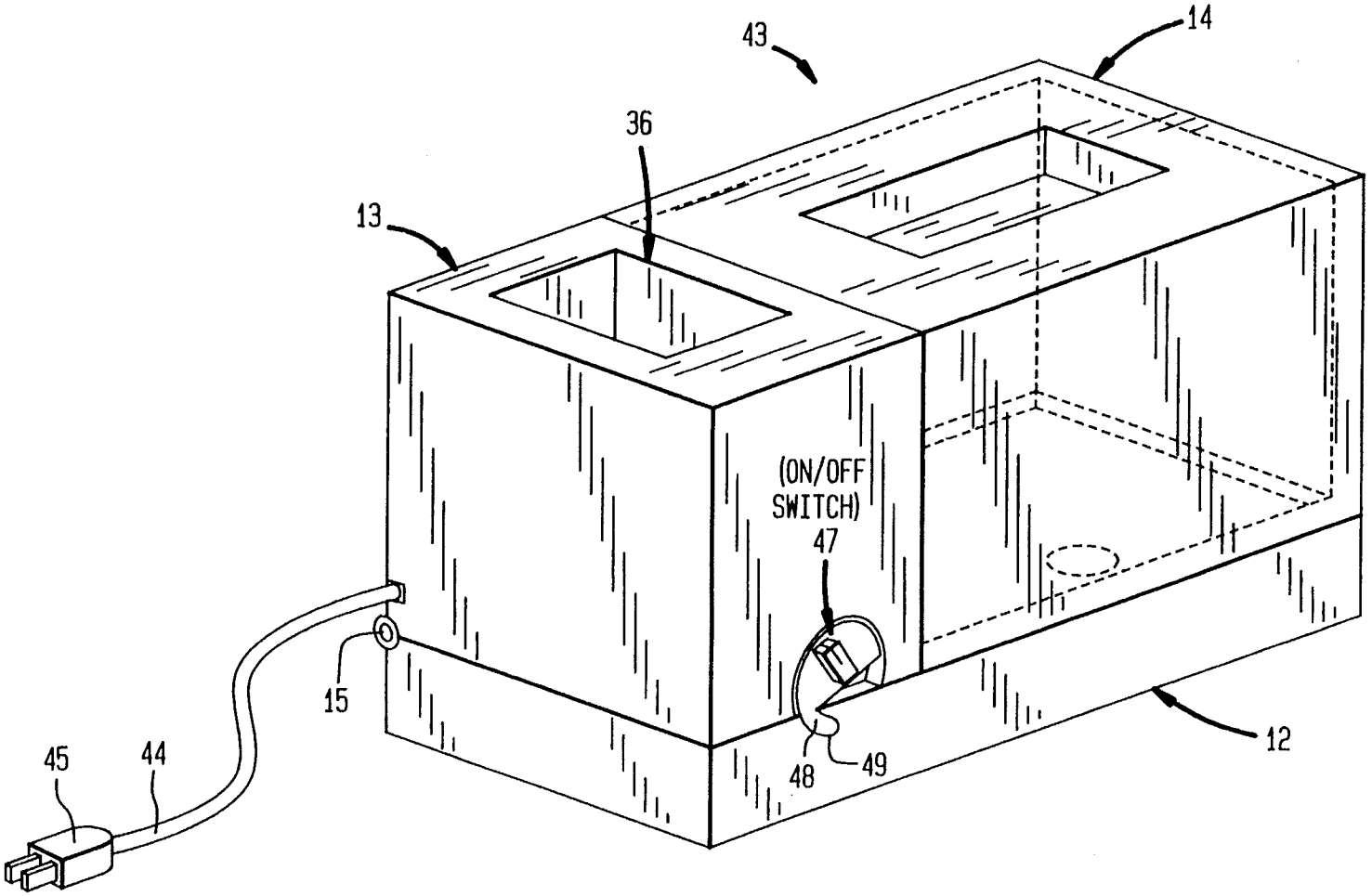
FIG. 4 is a front perspective view of another humidifier embodiment.

The humidifier embodiment 43 shown in FIG. 4 is similar to the embodiment 11 and common components bear the same reference numerals. Again a humidifier unit 13 and a supply tank 14 are removably mounted on a base 12. A power cord 44 is connected to the unit 13 and has a male plug 45 for connection to an a.c. power outlet (not shown).

Figure 6:
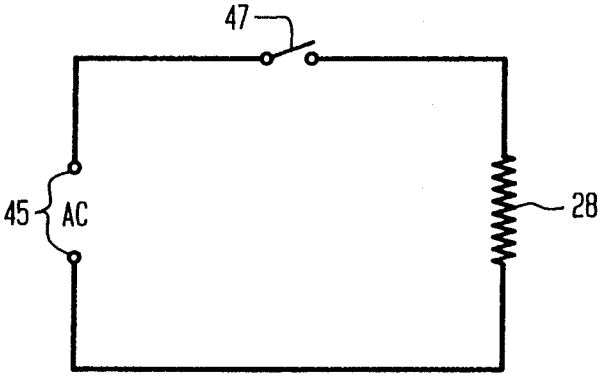
FIG. 6 is a circuit diagram for the humidifier of FIG. 4 and 5.
Figure 5:
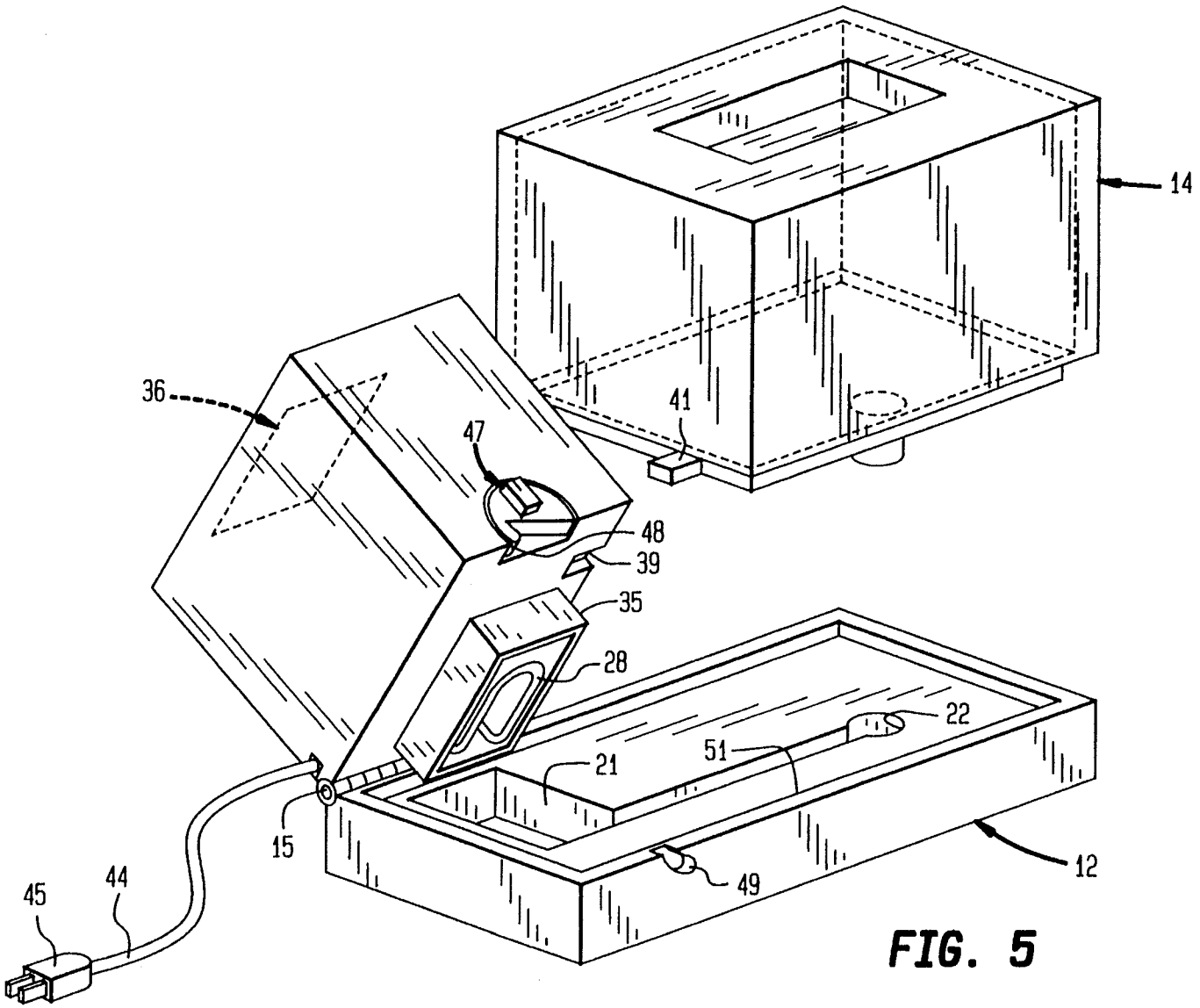
FIG. 5 is a perspective view of the humidifier shown in FIG. 4 with a tank and humidification unit displaced.

Retained by the unit 13 is a manually operated on-off switch 47 interconnected between the power cord 44 and the heater coil 28 as shown in FIG. 6. Formed on and rotatable with the switch 47 is a latch arm actuator 48 projecting outwardly. With the humidifier unit 13 mounted on the base 12 as shown in FIG. 4, the switch 47 can be rotated between an on position that energizes the heater coil 28 and an off position that causes de-energization thereof. During rotation of the switch 47 into its on position shown in FIG. 4, the actuator arm 48 enters an arcuate latch receptacle slot 49 formed in an upwardly projecting outer edge 51 of the base 12. With the arm 48 engaged in the slot 49, the humidifier unit 13 is not pivotable into the displaced position shown in FIG. 5. Such movement is possible only after rotation of the switch 47 to its off position withdrawing the latch arm 48 from the receptacle slot 49. Thus, the deactivating latch elements 48, 49 insure de-energization of the heater coil 28 before displacement of the humidifier unit 13 into the position shown in FIG. 5.

Figure 9:
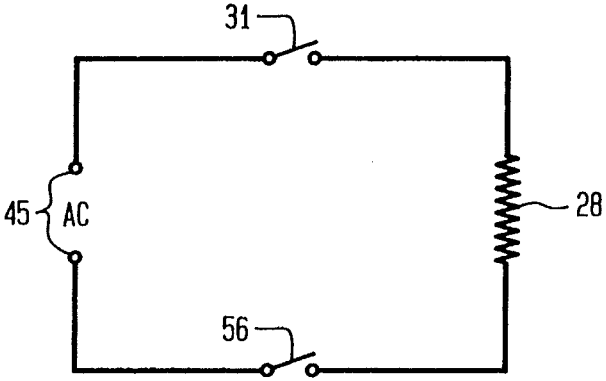
FIG. 9 is a circuit diagram for the humidifier of FIGS. 7 and 8.
Figure 7:
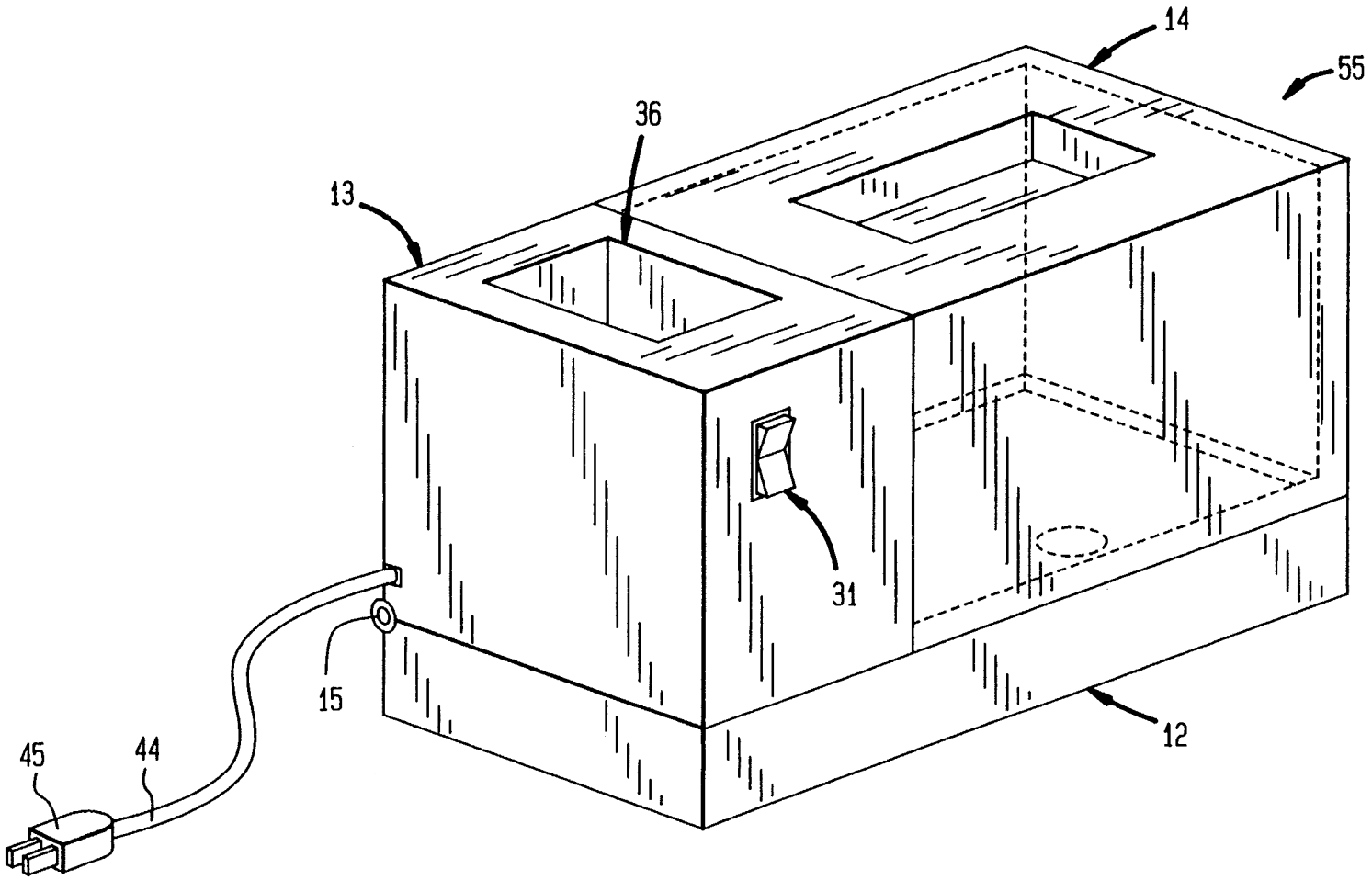
FIG. 7 is a front perspective view of another humidifier embodiment.
Figure 8:
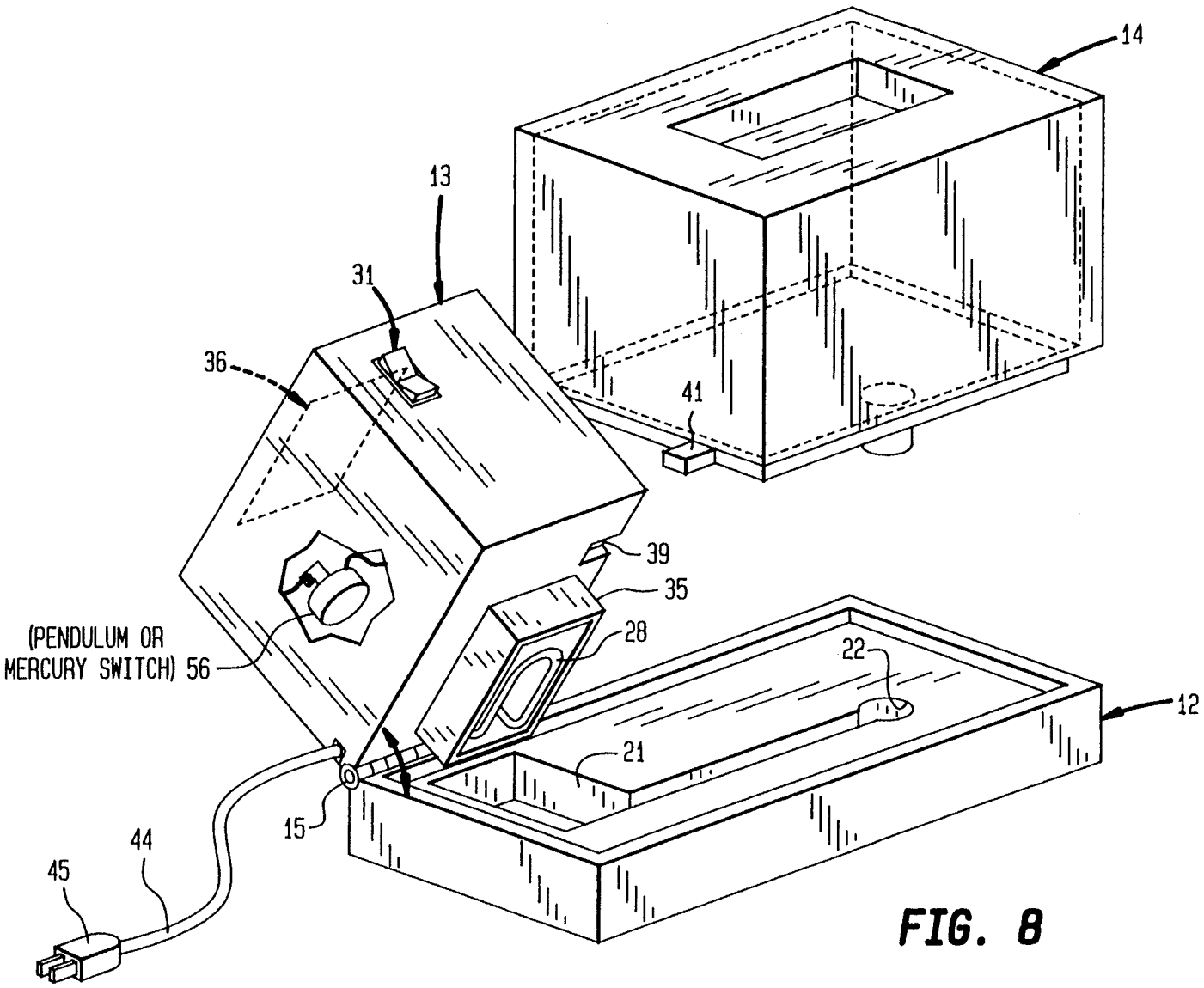
FIG. 8 is a partially broken away perspective view of the humidifier shown in FIG. 7 with a tank and humidification unit displaced.

FIGS. 7 and 8 illustrate another humidifier embodiment 55 similar to the embodiments 11 and 43 with common elements again bearing the same reference numerals. Retained by the humidifier unit 13 is an orientation responsive electrical switch 56 such as a conventional mercury or pendulum switch. The switch 56 is interconnected with the manual on-off switch 31, the power cord 44 and the heater coil 28 as shown in FIG. 9.

With the humidification unit 13 in an upright orientation on the base 12 as shown in FIG. 7, the switch 56 is actuated into a closed condition. Thus, the manual switch 31 can be activated to energize the heater coil 28 to induce dispersion of liquid in the reservoir 21. However, pivotal displacement (FIG. 8) of the humidifier unit 13 into an orientation other than the upright orientation of FIG. 7 causes the switch 56 to shift into an open condition. Thus, the deactivating orientation responsive switch 56 insures deenergization of the heater coil 28 with the humidifier unit 13 displaced from its operating upright position on the base 12.

It will be noted that the coupling elements 39, 41 also insure that either the latch elements 48, 49 of embodiment 43 or the orientation responsive switch 56 of embodiment 55 will deactivate the humidifier unit 13 prior to removal of the tank 14.

Obviously, many modifications and variations of the present invention are possible in light of the above teachings. It is to be understood, therefore, that the invention can be practiced otherwise than as specifically described.

What is claimed is:

1. A humidifier comprising:

base means defining a reservoir and a latch aperture;

a humidifier unit hingedly mounted on said base means over said reservoir and movable to provide access thereto, said humidifier unit including an electrically energized humidification means for inducing dispersion of liquid and defining a discharge opening for discharging liquid dispersed by said humidification means;

circuit means coupled to said humidification means and comprising an on-off switch for selectively controlling energization thereof, an electrical connection means retained by and connected to said humidification means for supplying power thereto, said connection means being aligned with said latch aperture when said humidifier unit is operatively mounted on said base means, and a power cord having an electrical plug detachably connectable with said connection means through said aperture when said humidifier unit is operatively mounted on said base means, and wherein engagement between said plug and said latch aperture of said base means prevents movement of said humidifier unit relative to said base means to prevent access to said reservoir so long as said plug and said connection means are in operative engagement.

2. A humidifier according to claim 1 including a tank mounted on said base means and adapted to feed liquid into said reservoir.

3. A humidifier according to claim 1 wherein said humidification means comprises an electrically energized heater disposed in said reservoir.

4. A humidifier according to claim 1 wherein all of said circuit means is retained by said humidifier unit.

* * * * *